US010914524B2

(12) United States Patent
Yanik et al.

(10) Patent No.: US 10,914,524 B2
(45) Date of Patent: Feb. 9, 2021

(54) UN-FINNED HEAT EXCHANGER

(71) Applicant: Danfoss Micro Channel Heat Exchanger (Jiaxing) Co., Ltd., Zhejiang (CN)

(72) Inventors: Mustafa K. Yanik, Zhejiang (CN); Pierre Olivier Pelletier, Zhejiang (CN); Jeffrey Lee Tucker, Zhejiang (CN)

(73) Assignee: Danfoss Micro Channel Heat Exchanger (Jianxing) Co., Ltd., Zhejiang (CN)

( * ) Notice: Subject to any disclaimer, the term of this patent is extended or adjusted under 35 U.S.C. 154(b) by 32 days.

(21) Appl. No.: 16/331,369

(22) PCT Filed: Sep. 8, 2017

(86) PCT No.: PCT/CN2017/101030

§ 371 (c)(1),
(2) Date: Mar. 7, 2019

(87) PCT Pub. No.: WO2018/045989

PCT Pub. Date: Mar. 15, 2018

(65) Prior Publication Data

US 2019/0360754 A1 Nov. 28, 2019

(30) Foreign Application Priority Data

Sep. 9, 2016 (CN) ..... 2016 1 0813164

(51) Int. Cl.

| | |
|---|---|
| ***F28D 1/00*** | (2006.01) |
| ***F28D 1/053*** | (2006.01) |
| ***F28F 9/02*** | (2006.01) |

(52) U.S. Cl.
CPC ..... *F28D 1/053* (2013.01); *F28F 9/02* (2013.01)

(58) Field of Classification Search
CPC ..... F28D 1/053; F28F 9/02
(Continued)

(56) References Cited

U.S. PATENT DOCUMENTS 2,523,990 A * 9/1950 Graham ..... F28D 7/04 165/163
3,702,632 A 11/1972 Grimshaw
(Continued)

FOREIGN PATENT DOCUMENTS

CN 201016587 Y 2/2008
CN 201233190 Y 5/2009
(Continued)

OTHER PUBLICATIONS

International Search Report for Serial No. PCT/CN2017/101030 dated Dec. 15, 2017.
(Continued)

*Primary Examiner* — Davis D Hwu
(74) *Attorney, Agent, or Firm* — McCormick, Paulding & Huber PLLC

(57) ABSTRACT

An un-finned heat exchanger (100). The heat exchanger (100) comprises: a heat exchange tube (1), which comprises a body; a fluid channel (11) formed inside the body; and a collecting tube (2) connected to the heat exchange tube (1). Using the heat exchanger can reduce accumulation of dirt on the heat exchanger.

17 Claims, 17 Drawing Sheets

(58) Field of Classification Search
USPC ..... 165/148
See application file for complete search history.

(56) References Cited

U.S. PATENT DOCUMENTS

| | | | | |
|---|---|---|---|---|
| 4,275,177 | A * | 6/1981 | Walkenhorst | B01F 15/066 165/109.1 |
| 4,287,724 | A * | 9/1981 | Clark | B01D 53/265 165/163 |
| 4,619,317 | A | 10/1986 | Disselbeck et al. | |
| 5,687,932 | A * | 11/1997 | Gomes | B64G 1/50 165/104.12 |
| 2003/0178188 | A1 * | 9/2003 | Coleman | F28F 1/022 165/164 |
| 2005/0241327 | A1 | 11/2005 | Daddis, Jr. et al. | |
| 2010/0089560 | A1 | 4/2010 | Shikazono et al. | |
| 2015/0099453 | A1 | 4/2015 | Eleftheriou et al. | |

FOREIGN PATENT DOCUMENTS

| | | | |
|---|---|---|---|
| CN | 101776357 | A | 7/2010 |
| CN | 101776403 | A | 7/2010 |
| CN | 101936670 | A | 1/2011 |
| CN | 102192672 | A | 9/2011 |
| CN | 102628654 | A | 8/2012 |
| CN | 202793131 | U | 3/2013 |
| CN | 202814186 | U | 3/2013 |
| CN | 203719250 | U | 7/2014 |
| CN | 203824169 | U | 9/2014 |
| EP | 2 447 626 | A2 | 5/2012 |
| JP | H09126680 | A | 5/1997 |
| JP | 2000337781 | A | 12/2000 |
| JP | 2002090081 | A | 3/2002 |
| JP | 2009-145010 | A | 7/2009 |
| JP | 2010-276298 | A | 12/2010 |
| JP | 2015-55413 | A | 3/2015 |
| KR | 2002-0094153 | A | 12/2002 |
| KR | 10-2009-0110976 | A | 10/2009 |
| KR | 101453304 | B1 | 10/2014 |
| WO | 2005116562 | A1 | 12/2005 |

OTHER PUBLICATIONS

Partial European Search Report for Serial No. 17848162.8 dated Apr. 14, 2020.

Extended European Search Report for European Application Serial No. 17848162.8 dated Aug. 3, 2020.

* cited by examiner

UN-FINNED HEAT EXCHANGER

CROSS-REFERENCE TO RELATED APPLICATIONS

This application is a National Stage application of International Patent Application No. PCT/CN2017/101030, filed on Sep. 8, 2017, which claims priority to Chinese Patent Application No. 201610813164.5, filed on Sep. 9, 2016, each of which is hereby incorporated by reference in its entirety.

TECHNICAL FIELD

The embodiments of the present invention relate to an unfinned heat exchanger.

BACKGROUND

An unfinned heat exchanger is a heat exchanger without any fins.

SUMMARY

The objective of the embodiments of the present invention is to provide an unfinned heat exchanger, so as, for example, to reduce the accumulation of dirt on the heat exchanger.

According to an embodiment of the present invention, an unfinned heat exchanger is provided. The unfinned heat exchanger comprises a heat exchange tube which comprises a body, a fluid passage formed in said body, and a manifold connected to the heat exchange tube.

According to an embodiment of the present invention, the body of said heat exchange tube has at least two straight-line body portions, when viewed from its cross-section.

According to the embodiments of the present invention the body of said heat exchange tube comprises three straight-line body portions, when viewed from the cross-section, the first body portion of the three straight-line body portions is extended in a first direction, the second body portion of the three straight-line body portions is extended from an end of the first body portion in a second direction oblique to the first direction, and the third body portion of the three straight-line body portions is extended from an end of the second body portion, away from the first body portion, in a third direction roughly parallel to the first direction.

According to an embodiment of the present invention, the body of said heat exchange tube comprises four straight-line body portions, when viewed from the cross-section, and the body of said heat exchange tube is in the shape of an inverted W.

According to an embodiment of the present invention, said heat exchange tube further comprises at least one bulge formed on the surface opposite to said body.

According to an embodiment of the present invention, said bulge is continuously extended in a longitudinal direction of said heat exchange tube.

According to an embodiment of the present invention, a heat exchange tube support is provided, said heat exchange tube support comprises a support body and a through-hole passing through the support body, and said heat exchange tube is respectively threaded through the through-hole in said heat exchange tube support. According to an embodiment of the present invention, said heat exchange tube comprises a first row of heat exchange tube and a second row of heat exchange tube, said manifold comprises a first manifold and a second manifold, a first end of the first row of heat exchange tube and a first end of the second row of heat exchange tube are connected to the first manifold, and a second end of the first row of heat exchange tube and a second end of the second row of heat exchange tube are connected to the second manifold.

According to the embodiments of the present invention, said heat exchange tube comprises a first row of heat exchange tube and a second row of heat exchange tube, and the first row of heat exchange tube and the second row of heat exchange tube are mutually staggered in an arrangement direction of the heat exchange tubes.

According to an embodiment of the present invention, said manifold comprises a first manifold and a second manifold respectively connected to the first row of heat exchange tube and the second row of heat exchange tube, a position of an opening used to insert an end of the first row of heat exchange tube in the first manifold and a position of an opening used to insert an end of the second row of heat exchange tube in the second manifold are mutually staggered in an arrangement direction of the first row of heat exchange tube or the second row of heat exchange tube.

According to an embodiment of the present invention, an endface of the first manifold and an endface of the second manifold, which are on a same side in said arrangement direction, are roughly aligned in said arrangement direction, or an endface of the first manifold and an endface of the second manifold, which are on the same side in said arrangement direction, are spaced at a preset distance in said arrangement direction.

According to an embodiment of the present invention, the first manifold is a first pair of manifolds and the second manifold is a second pair of manifolds.

According to an embodiment of the present invention, the first manifold and the second manifold are connected to a first end and a second end of the heat exchange tube, respectively, the heat exchange tube is bent in its middle to form a first row of heat exchange tube and a second row of heat exchange tube, and the first manifold and the second manifold are located on the same side of the heat exchanger.

According to an embodiment of the present invention, said manifold comprises a first pair of manifolds and a second pair of manifolds respectively connected to the first row of heat exchange tube and the second row of heat exchange tube, the position of an opening used to insert an end of the first row of heat exchange tube in the first pair of manifolds and the position of an opening used to insert an end of the second row of heat exchange tube in the second pair of manifolds are mutually staggered in an arrangement direction of the first row of heat exchange tube or the second row of heat exchange tube, and the endfaces of the first pair of manifolds and the second pair of manifolds on the same side in the arrangement direction of the heat exchange tube are roughly aligned in said arrangement direction.

According to an embodiment of the present invention, said manifolds comprise a first manifold and a second manifold respectively connected to a first end and a second end of the heat exchange tube, the first manifold and the second manifold are located on the same side of the heat exchanger by bending the heat exchange tube in the middle, the position of an opening used to insert the first end of the heat exchange tube in the first manifold and the position of an opening used to insert the second end of the heat exchange tube in the second manifold are mutually staggered in an arrangement direction of the heat exchange tube, and the endfaces of the first manifold and the second manifold on the same side in the arrangement direction of the heat exchange tube are roughly aligned in said arrangement direction.

According to an embodiment of the present invention, said manifold comprises a first pair of manifolds and a second pair of manifolds respectively connected to the first row of heat exchange tube and the second row of heat exchange tube, the position of an opening used to insert an end of the first row of heat exchange tube in the first pair of manifolds and the position of an opening used to insert an end of the second row of heat exchange tube in the second pair of manifolds are mutually staggered in the arrangement direction of the first row of heat exchange tube or the second row of heat exchange tube, and the endfaces of the first pair of manifolds and the second pair of manifolds on the same side in the arrangement direction of the first row of heat exchange tube or the second row of heat exchange tube are spaced at a preset distance in said arrangement direction.

According to an embodiment of the present invention, said manifold comprises a first manifold and a second manifold respectively connected to a first end and a second end of the heat exchange tube, the first manifold and the second manifold are located on the same side of the heat exchanger by bending the heat exchange tube in the middle, the position of an opening used to insert a first end of the heat exchange tube in the first manifold and the position of an opening used to insert a second end of the heat exchange tube in the second manifolds are mutually staggered in an arrangement direction of the heat exchange tube, and the endfaces of the first manifold and the second manifold on the same side in the arrangement direction of the heat exchange tube are spaced at a preset distance in said arrangement direction.

According to an embodiment of the present invention, an end of said heat exchange tube supports an inner wall of the manifold.

According to an embodiment of the present invention, an endface of said heat exchange tube contacts an inner wall of the manifold or a blocking structure contacting an outer wall of the manifold is provided on said heat exchange tube.

According to an embodiment of the present invention, at least one end of said heat exchange tube has an endface oblique to a longitudinal direction of the heat exchange tube.

According to an embodiment of the present invention, two ends of said heat exchange tube have endfaces oblique to a longitudinal direction of the heat exchange tube, and the oblique endfaces of the two ends of said heat exchange tube are roughly parallel to each other.

According to an embodiment of the present invention, at least one of two ends of said heat exchange tube has a first endface portion which is extended from a first edge of the heat exchange tube to a middle in a widthwise direction of said heat exchange tube and is oblique to a longitudinal direction of the heat exchange tube, and a second endface portion which is extended from a second edge opposite to the first edge in the widthwise direction of the heat exchange tube to the middle in the widthwise direction of said heat exchange tube and is oblique to the longitudinal direction of the heat exchange tube.

According to the embodiments of the present invention, a pointed portion is formed between the first endface portion and the second endface portion and said pointed portion contacts an inner wall of the manifold.

According to the embodiments of the present invention, an endface of said heat exchange tube supports an inner wall of the manifold through a supporting element or the endface of said heat exchange tube contacts a supporting element connected to the manifold.

According to an embodiment of the present invention, the manifold has an opening used to insert an end of the heat exchange tube therein and a supporting element insertion mouth opposite to the opening, said heat exchanger further comprises a supporting element, and said supporting element is inserted from the supporting element mouth into the manifold to abut an endface of the end of the heat exchange tube inserted from said opening.

According to an embodiment of the present invention, said supporting element has a rod portion inserted in said insertion mouth and a head portion connected to the rod portion and located outside the manifold, and said head portion covers said insertion mouth.

According to an embodiment of the present invention, at least one of said heat exchange tube has a strip shape and is twisted into a spiral shape. According to an embodiment of the present invention, said heat exchange tube comprises a first row of heat exchange tube and a second row of heat exchange tube, at least one heat exchange tube of said first row of heat exchange tube has a strip shape and is twisted into a spiral shape, at least one heat exchange tube of said second row of heat exchange tube has a strip shape and is twisted into a spiral shape, two opposite edges of the strip-shaped heat exchange tube of said first row of heat exchange tube have a wave shape and have a first wave peak, a first wave trough and a first intersection point in a projection on a plane defined by an arrangement direction of the first row of heat exchange tube and a longitudinal direction of the heat exchange tube of the first row of heat exchange tube; two opposite edges of the strip-shaped heat exchange tube of said second row of heat exchange tube have a wave shape and have a second wave peak, a second wave trough and a second intersection point in a projection on a plane defined by an arrangement direction of the second row of heat exchange tube and a longitudinal direction of the heat exchange tube of the second row of heat exchange tube, and said first wave peak and first wave trough are staggered from said second wave peak and second wave trough in a longitudinal direction of the heat exchange tube of the first row of heat exchange tube or the second row of heat exchange tube.

According to an embodiment of the present invention, said first wave peak and first wave trough are roughly located in a same position as the second intersection point in the longitudinal direction of the heat exchange tube of the first row of heat exchange tube or second row of heat exchange tube, or said second wave peak and second wave trough are roughly located in a same position as the first intersection point in the longitudinal direction of the heat exchange tube of the first row of heat exchange tube or second row of heat exchange tube.

According to an embodiment of the present invention, at least one of said heat exchange tube has a strip shape and has a wave shape in a projection on a plane defined by an arrangement direction of the heat exchange tube and a longitudinal direction of the heat exchange tube.

According to an embodiment of the present invention, at least two adjacent heat exchange tubes of said heat exchange tube have a strip shape, said at least two heat exchange tubes of said heat exchange tube have a wave shape and have a wave peak and a wave trough in a projection on a plane defined by an arrangement direction of the heat exchange tube and a longitudinal direction of the heat exchange tube, and the wave trough of one heat exchange tube of said at least two heat exchange tubes and the wave peak of the other lower and adjacent heat exchange tube are roughly located in a same position, or are staggered a preset distance in the longitudinal direction of the heat exchange tube.

According to an embodiment of the present invention, said heat exchange tube comprises a first row of heat exchange tube and a second row of heat exchange tube, at least two adjacent heat exchange tubes of said first row of heat exchange tube have a strip shape, at least two adjacent heat exchange tubes of the second row of heat exchange tube have a strip shape, said at least two heat exchange tubes of said first row of heat exchange tube have a wave shape and have a wave peak and a wave trough, in a projection on a plane defined by an arrangement direction of the first row of heat exchange tube and a longitudinal direction of the heat exchange tube of the first row of heat exchange tube, and the wave trough of one heat exchange tube of said at least two heat exchange tubes of said first row of heat exchange tube and the wave peak of the other lower and adjacent heat exchange tube of said at least two heat exchange tubes of said first row of heat exchange tube are roughly located in a same position in a longitudinal direction of the heat exchange tube of the first row of heat exchange tube; said at least two heat exchange tubes in said second row of heat exchange tube have a wave shape and have a wave peak and a wave trough, in a projection on a plane defined by an arrangement direction of the second row of heat exchange tube and a longitudinal direction of the heat exchange tube of the second row of heat exchange tube, and the wave trough of one heat exchange tube of said at least two heat exchange tubes of said second row of heat exchange tube and the wave peak of the other lower and adjacent heat exchange tube of said at least two heat exchange tubes of said second row of heat exchange tube are roughly located in a same position in the longitudinal direction of the heat exchange tube of the second row of heat exchange tube; a wave peak or a wave trough of one identically-positioned heat exchange tube of said at least two heat exchange tubes of said first row of heat exchange tube is staggered from a wave peak or a wave trough of one identically-positioned heat exchange tube of said at least two heat exchange tubes of said second row of heat exchange tube in the same position of said one identically-positioned heat exchange tube, in a longitudinal direction of the heat exchange tube of the first row of heat exchange tube or second row of heat exchange tube and in an arrangement direction of the first row of heat exchange tube or second row of heat exchange tube.

According to an embodiment of the present invention, the wave peak or the wave trough of one identically-positioned heat exchange tube of said at least two heat exchange tubes of said first row of heat exchange tube is located roughly in a same position as the wave trough or the wave peak of one identically-positioned heat exchange tube of said at least two heat exchange tubes of said second row of heat exchange tube in the same position of said one identically-positioned heat exchange tube in a longitudinal direction of the heat exchange tube of the first row of heat exchange tube or second row of heat exchange tube and in an arrangement direction of the first row of heat exchange tube or second row of heat exchange tube.

According to an embodiment of the present invention, said wave shape is a sinusoidal wave shape or a trapezoidal wave shape.

According to an embodiment of the present invention, a manufacturing method of an unfinned heat exchanger is provided, and said manufacturing method comprises: providing a heat exchange tube and a manifold, the manifold having an opening used to insert an end of the heat exchange tube therein, inserting the end of the heat exchange tube into the opening in the manifold, bundling the heat exchanger by use of a long and thin strapping piece, with a part of the strapping piece wound on a part of an outer circumference of the manifold, and braze welding the heat exchanger in a heating furnace.

According to an embodiment of the present invention, the strapping piece is extended roughly in a plane forming a preset angle with an axial direction of the manifold.

According to an embodiment of the present invention, said preset angle is roughly 90 degrees.

According to an embodiment of the present invention, an end of said heat exchange tube supports an inner wall of the manifold.

According to an embodiment of the present invention, an endface of said heat exchange tube contacts an inner wall of the manifold.

According to an embodiment of the present invention, an endface of said heat exchange tube supports an inner wall of the manifold through a supporting element or the endface of said heat exchange tube contacts the supporting element connected to the manifold.

The heat exchanger according to the embodiments of the present invention can reduce the accumulation of dirt on the heat exchanger.

DETAILED DESCRIPTION

The following further describes the present invention in combination with the drawings and specific embodiments.

See FIG. 1 to FIG. 37. The unfinned heat exchanger 100 in an embodiment of the present invention comprises: a heat exchange tube 1, said heat exchange tube 1 comprising a body; a fluid passage 11 formed in said body; and a manifold 2 connected to the heat exchange tube 1.

Figure 2:
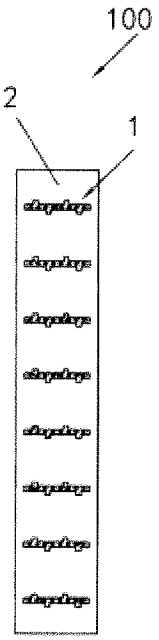
FIG. 2 is a cutaway view of the unfinned heat exchanger in an embodiment of the present invention in the direction of line AA in FIG. 1.
Figure 1:
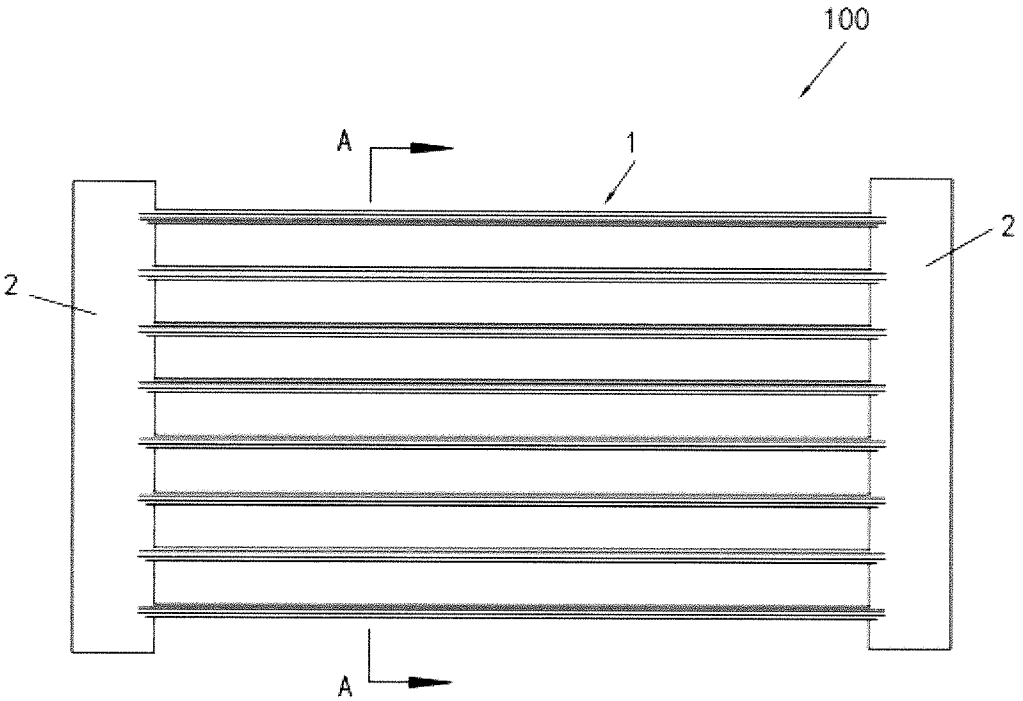
FIG. 1 is a front view of an unfinned heat exchanger in an embodiment of the present invention.
Figure 4:
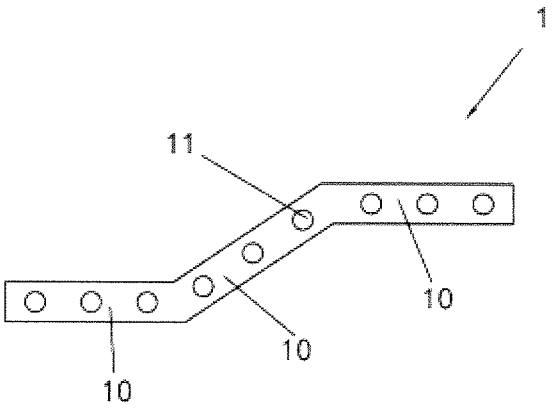
FIG. 4 is a cutaway view of a heat exchange tube of the heat exchanger in another embodiment of the present invention.
Figure 5:
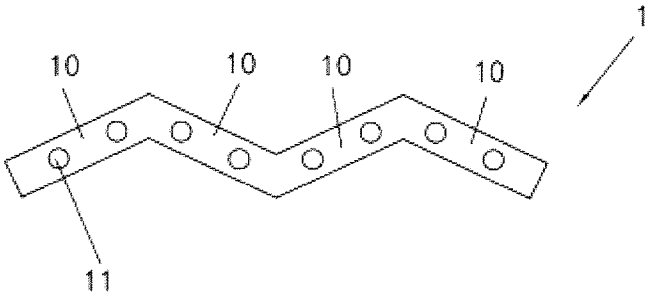
FIG. 5 is a cutaway view of a heat exchange tube of the heat exchanger in a further embodiment of the present invention.
Figure 6:
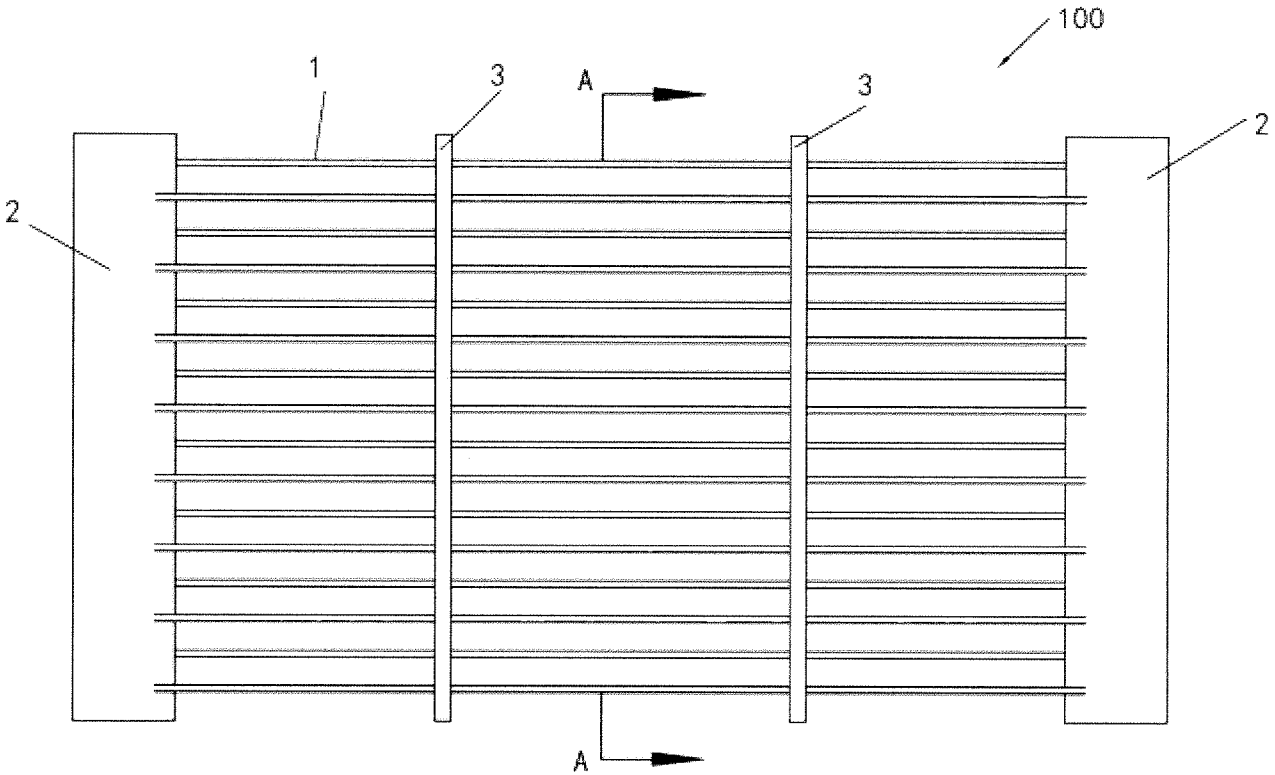
FIG. 6 is a front view of an unfinned heat exchanger in an embodiment of the present invention.
Figure 9:
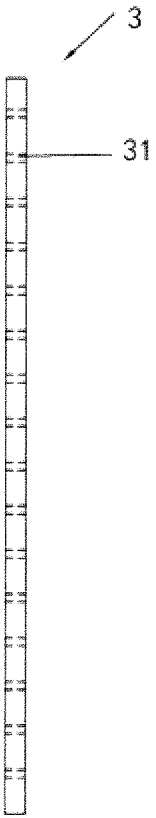
FIG. 9 is a side view of a heat exchange tube support of an unfinned heat exchanger in an embodiment of the present invention.
Figure 8:
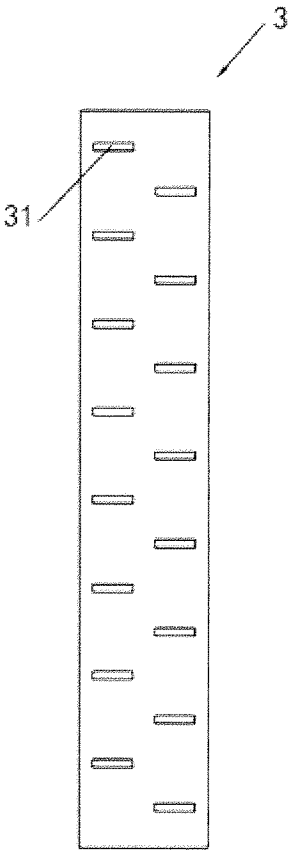
FIG. 8 is a front view of a heat exchange tube support of an unfinned heat exchanger in an embodiment of the present invention.
Figure 7:
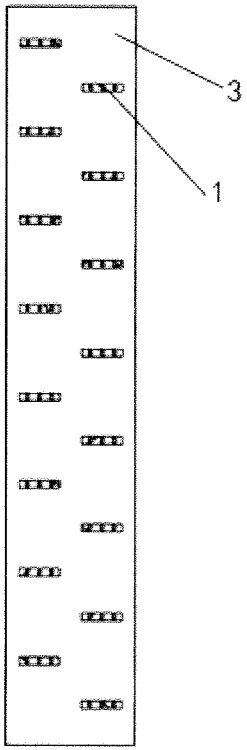
FIG. 7 is a cutaway view of the unfinned heat exchanger in an embodiment of the present invention shown in FIG. 6 cut in the direction of line AA.

See FIG. 4 and FIG. 5. In an embodiment of the present invention the body of said heat exchange tube 1 has at least two straight-line body portions 10, when viewed from its cross-section. For example, as shown in FIG. 4, when viewed from its cross-section, the body of said heat exchange tube 1 comprises three straight-line body portions 10, the first body portion 10 of the three straight-line body portions 10 is extended in a first direction, the second body portion 10 of the three straight-line body portions is extended from an end of the first body portion 10 in a second direction oblique to the first direction, and the third body portion 10 of the three straight-line body portions 10 is extended from the end of the second body portion 10, away from the first body portion, in a third direction roughly parallel to the first direction. Alternatively, the third direction is oblique to the first direction and the second direction. For example, as shown in FIG. 5, when viewed from its cross-section, the body of said heat exchange tube 1 comprises four straight-line body portions 10 and the body of said heat exchange tube 1 is in the shape of an inverted W.

Figure 3:
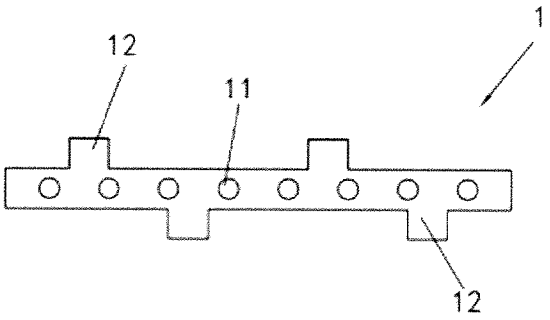
FIG. 3 is a cutaway view of a heat exchange tube of the heat exchanger in one embodiment of the present invention.

See FIG. 3. In an embodiment of the present invention, said heat exchange tube 1 further comprises at least one bulge 12 formed on a surface opposite to said body. Said bulge 12 can continuously be extended in a longitudinal direction of said heat exchange tube 1. The bulge 12 can be a rib portion.

Since the heat exchange tube 1 has bulge 13 and is arranged in a shape of steps or in a shape of an inverted W, turbulence is formed when air passes through the heat exchange tube 1. Thus, the heat exchange performance is improved, and in addition, the bending strength of the heat exchange tube 1 is also improved.

See FIG. 6 to FIG. 9. In an embodiment of the present invention, said unfinned heat exchanger 100 further comprises a heat exchange tube support 3, said heat exchange tube support 3 comprises a support body and a through-hole 31 passing through the support body, and said heat exchange tube 1 is respectively threaded through the through-hole 31 in said heat exchange tube support 3. In an embodiment of the present invention, said heat exchange tube 1 comprises a first row of heat exchange tube 1 and a second row of heat exchange tube 1, said manifold 2 comprises a first manifold 2 and a second manifold 2, a first end of the first row of heat exchange tube 1 and a first end of the second row of heat exchange tube 1 are connected to the first manifold 2, and a second end of the first row of heat exchange tube 1 and a second end of the second row of heat exchange tube 1 are connected to the second manifold 2. At least one of the first manifold 2 and the second manifold 2 has a longitudinal baffle, the longitudinal baffle divides an inner cavity of at least one of the first manifold 2 and the second manifold 2 into two chambers. Said heat exchange tube support 3 can be a plate-like element. For example, the thickness of the plate-like element is about 1 mm. The plate-like element can have a coating on one side or two sides so that it can be welded together with the heat exchange tube.

See FIG. 10 to FIG. 21. In an embodiment of the present invention, said heat exchange tube 1 comprises a first row of heat exchange tube 1 and a second row of heat exchange tube 1, and the first row of heat exchange tube 1 and the second row of heat exchange tube 1 are mutually staggered in the arrangement direction DA of the heat exchange tube 1. Thus, the air passing through the first row of heat exchange tube 1 impacts the second row of heat exchange tube 1 and gets separated. Then the boundary layer is destroyed, and the heat exchange performance of the heat exchanger is improved.

See FIG. 10 to FIG. 21. In the embodiments of the present invention, said manifold 2 comprises a first manifold 2 and a second manifold 2 respectively connected to the first row of heat exchange tube 1 and the second row of heat exchange tube 1, the position of the opening used to insert an end of the first row of heat exchange tube 1 in the first manifold 2 and the position of the opening used to insert an end of the second row of heat exchange tube 1 in the second manifold 2 are mutually staggered in the arrangement direction DA of the first row of heat exchange tube 1 or the second row of heat exchange tube 1.

See FIG. 10 to FIG. 21. In the embodiments of the present invention, the endfaces 21 of the first manifold 2 and the second manifold 2 on the same side in said arrangement direction DA are roughly aligned in said arrangement direction DA, or the endfaces 21 of the first manifolds 2 and the second manifolds 2 on the same side in said arrangement direction are a preset distance apart in said arrangement direction DA.

See FIG. 10 to FIG. 12 and FIG. 16 to FIG. 18. In the embodiments of the present invention, the first manifold 2 is a first pair of manifolds 2 and the second manifold 2 is a second pair of manifolds 2.

See FIG. 13 to FIG. 15 and FIG. 19 to FIG. 21. In the embodiments of the present invention, the first manifold 2 and the second manifold 2 are connected to a first end and a second end of the heat exchange tubes 1, respectively, the heat exchange tube 1 is bent in its middle to form a first row of heat exchange tube 1 and a second row of heat exchange tube 1, and the first manifold 2 and the second manifold 2 are located on the same side of the heat exchanger.

Figure 11:
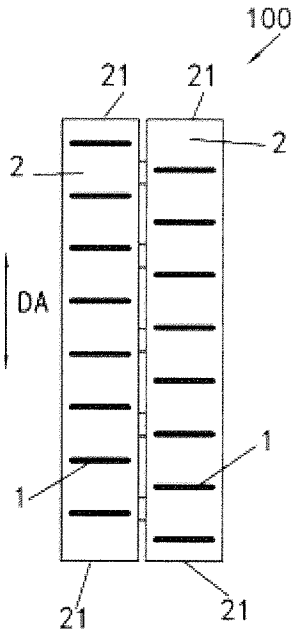
FIG. 11 is a cutaway view of the unfinned heat exchanger in an embodiment of the present invention shown in FIG. 10 cut in the direction of line AA.
Figure 10:
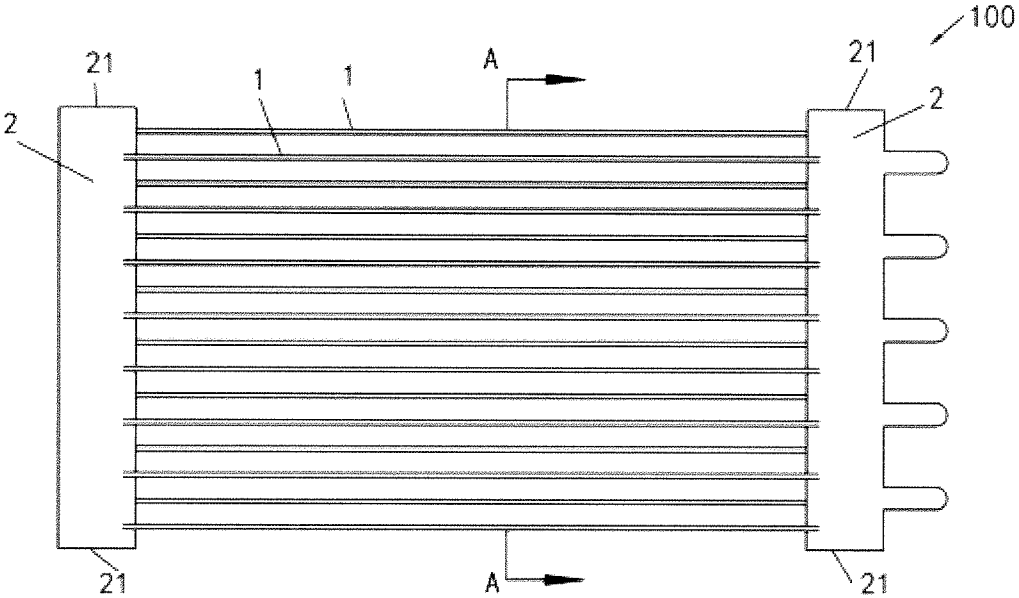
FIG. 10 is a front view of an unfinned heat exchanger in an embodiment of the present invention.
Figure 12:
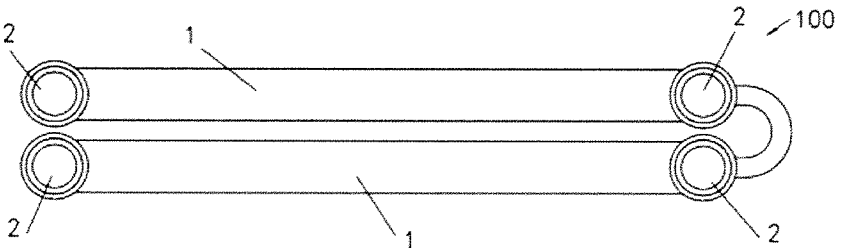
FIG. 12 is a top view of an unfinned heat exchanger in an embodiment of the present invention.

See FIG. 10 to FIG. 12. In the embodiments of the present invention, said manifold 2 comprises a first of pair of manifolds 2 and a second pair of manifolds 2 respectively connected to the first row of heat exchange tube 1 and the second row of heat exchange tube 1, the position of the opening used to insert an end of the first row of heat exchange tube 1 in the first pair of manifolds 2 and the position of the opening used to insert an end of the second row of heat exchange tube 1 in the second pair of manifolds 2 are mutually staggered in the arrangement direction DA of the first row of heat exchange tube 1 or the second row of heat exchange tube 1, and the endfaces 21 of the first pair of manifolds 2 and the second pair of manifolds 2 on the same side in the arrangement direction DA of heat exchange tubes 1 are roughly aligned in said arrangement direction DA. That is to say, the positions of the openings used to insert the ends of heat exchange tubes 1 in the first pair of manifolds 2 and the second pair of manifolds 2 are different in the longitudinal direction of the manifolds. The first manifold 2 and the second manifold 2 on the same side of the heat exchanger can be connected through connecting tubes.

Figure 13:
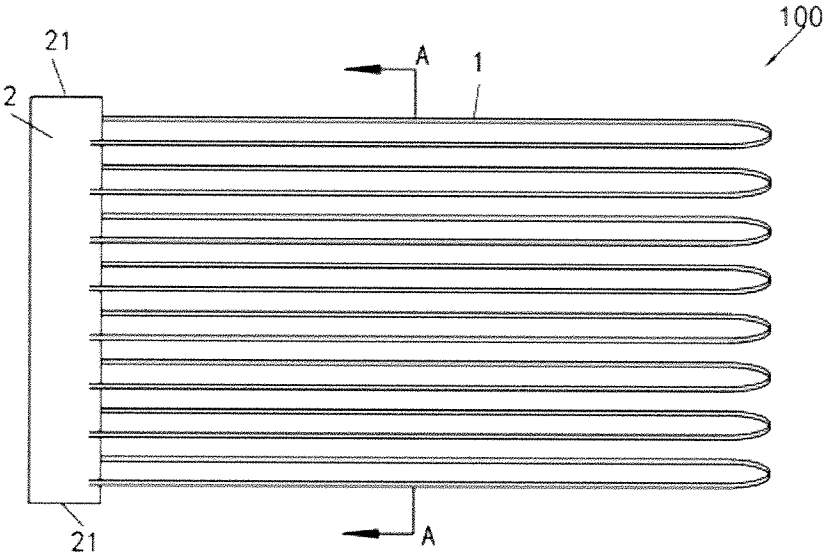
FIG. 13 is a front view of an unfinned heat exchanger in an embodiment of the present invention.
Figure 14:
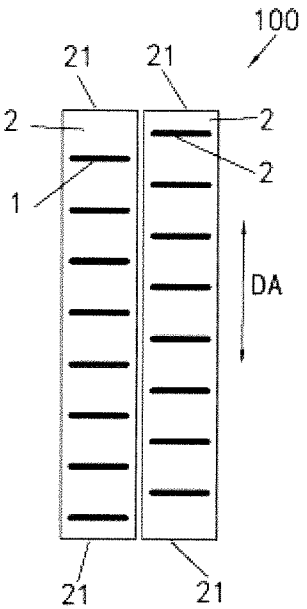
FIG. 14 is a cutaway view of the unfinned heat exchanger in an embodiment of the present invention shown in FIG. 13 cut in the direction of line AA.
Figure 15:
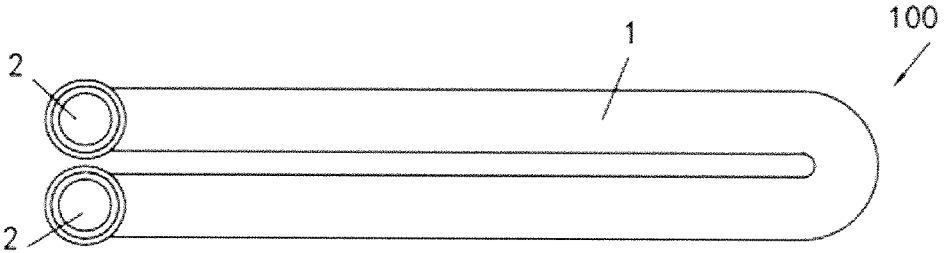
FIG. 15 is a top view of an unfinned heat exchanger in an embodiment of the present invention.

See FIG. 13 to FIG. 15. In the embodiments of the present invention, said manifold 2 comprises a first manifold 2 and a second manifold 2 respectively connected to a first end and a second end of the heat exchange tube 1, the first manifold 2 and the second manifold 2 are located on the same side (left side in FIG. 13) of the heat exchanger 100 by bending the heat exchange tube 1 in the middle, the position of the opening used to insert the first end of heat exchange tube 1 in the first manifold 2 and the position of the opening used to insert the second end of heat exchange tube 1 in the second manifold 2 are mutually staggered in the arrangement direction DA of heat exchange tube 1, and the endfaces 21 of the first manifold 2 and the second manifold 2 on the same side in the arrangement direction DA of the heat exchange tube 1 are roughly aligned in said arrangement direction DA. That is to say, the positions of the openings of the first manifold 2 and the second manifold 2 for inserting an end of the heat exchange tube 1 are different in the longitudinal direction of the manifold. It should be pointed out that "middle" is not limited to the center of a heat exchange tube in the lengthwise direction but refers to the middle part relative to the two ends of the heat exchange tube 1 in the lengthwise direction.

Figure 17:
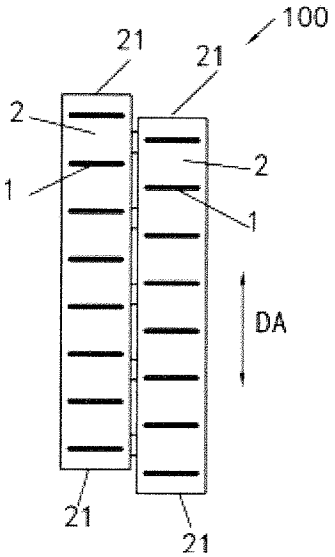
FIG. 17 is a cutaway view of the unfinned heat exchanger in an embodiment of the present invention shown in FIG. 16 cut in the direction of line AA.
Figure 16:
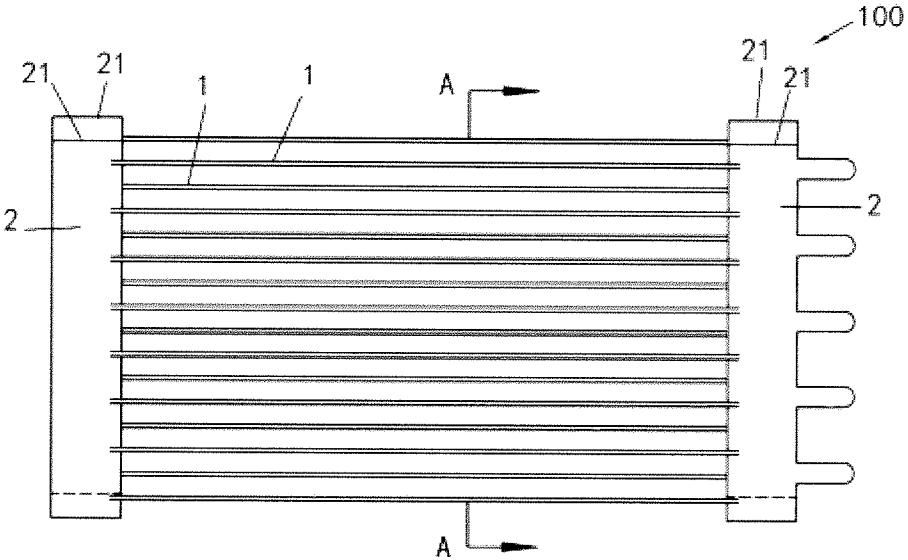
FIG. 16 is a front view of an unfinned heat exchanger in an embodiment of the present invention.
Figure 18:
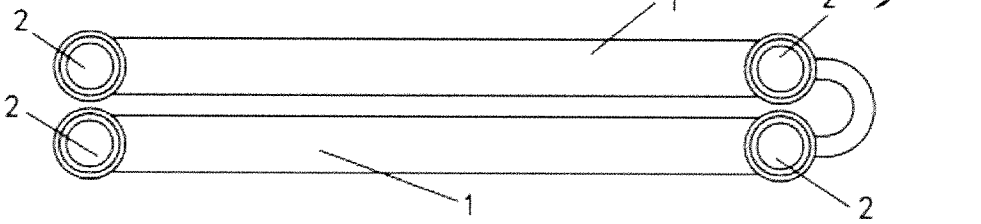
FIG. 18 is a top view of an unfinned heat exchanger in an embodiment of the present invention.

See FIG. 16 to FIG. 18. In the embodiments of the present invention, said manifold 2 comprises a first pair of manifolds 2 and a second pair of manifolds 2 respectively connected to the first row of heat exchange tube 1 and the second row of heat exchange tube 1, the positions of the openings of the first pair of manifolds 2 for inserting an end of the first row of heat exchange tube 1 and the positions of the openings of the second pair of manifolds 2 for inserting an end of the second row of heat exchange tube 1 are mutually staggered in the arrangement direction DA of the first row of heat exchange tube 1 or the second row of heat exchange tube 1, and the endfaces 21 of the first pair of manifolds 2 and the second pair of manifolds 2 on the same side in the arrangement direction DA of the first row of heat exchange tube 1 or the second row of heat exchange tube 1 are a preset distance apart in said arrangement direction DA. That is to say, the positions of the openings of the first pair of manifolds 2 and the second pair of manifolds 2 for inserting the ends of the heat exchange tubes 1 are the same in the longitudinal direction of the manifolds, but the first row of heat exchange tube 1 and the second row of heat exchange tube 1 are staggered through the deviation of the first pair of manifolds 2 from the second pair of manifolds 2 in the arrangement direction DA of the first row of heat exchange tube 1 or the second row of heat exchange tube 1. The first manifold 2 and the second manifold 2 on the same side of the heat exchanger are connected through connecting tubes.

Figure 19:
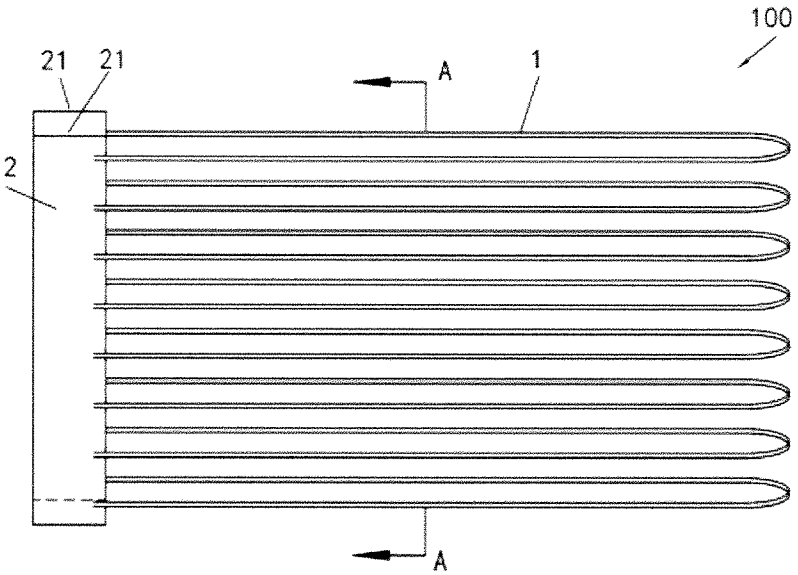
FIG. 19 is a front view of an unfinned heat exchanger in an embodiment of the present invention.
Figure 21:
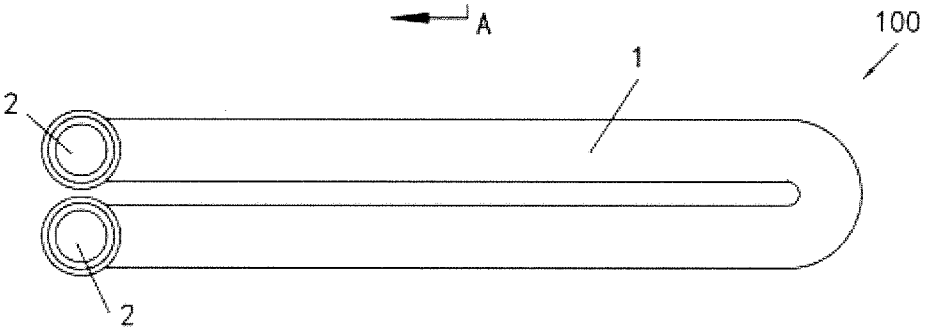
FIG. 21 is a top view of an unfinned heat exchanger in an embodiment of the present invention.
Figure 20:
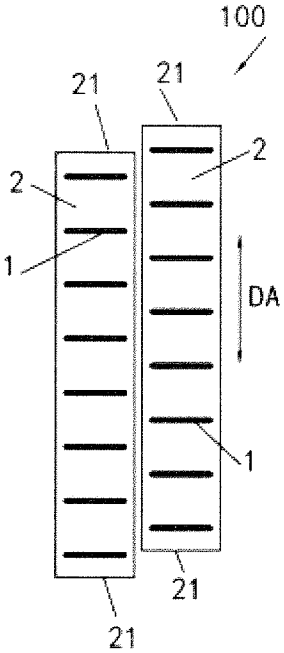
FIG. 20 is a cutaway view of an unfinned heat exchanger in an embodiment of the present invention shown in FIG. 19 cut in the direction of line AA.

See FIG. 19 to FIG. 21. In the embodiments of the present invention, said manifold 2 comprises a first manifold 2 and a second manifold 2 respectively connected to a first end and a second end of the heat exchange tube 1, the first manifold 2 and the second manifold 2 are located on the same side of the heat exchanger 100 by bending the heat exchange tube 1 in the middle, the position of the opening of the first manifold 2 for inserting a first end of the heat exchange tube 1 and the position of the opening of the second manifold 2 for inserting a second end of the heat exchange tube 1 are mutually staggered in the arrangement direction DA of heat exchange tubes 1, and the endfaces 21 of the first manifold 2 and the second manifold 2 on the same side in the arrangement direction DA of the heat exchange tube 1 are a preset distance apart in said arrangement direction DA. That is to say, the positions of the openings of the first manifold 2 and the second manifold 2 for inserting the end of the heat exchange tube 1 are the same in the longitudinal direction of the manifolds, but the first row of heat exchange tube 1 and the second row of heat exchange tube 1 formed by bending the heat exchange tubes are staggered through the deviation of the first manifold 2 from the second manifold 2 in the arrangement direction DA of the heat exchange tube 1.

Figure 22:
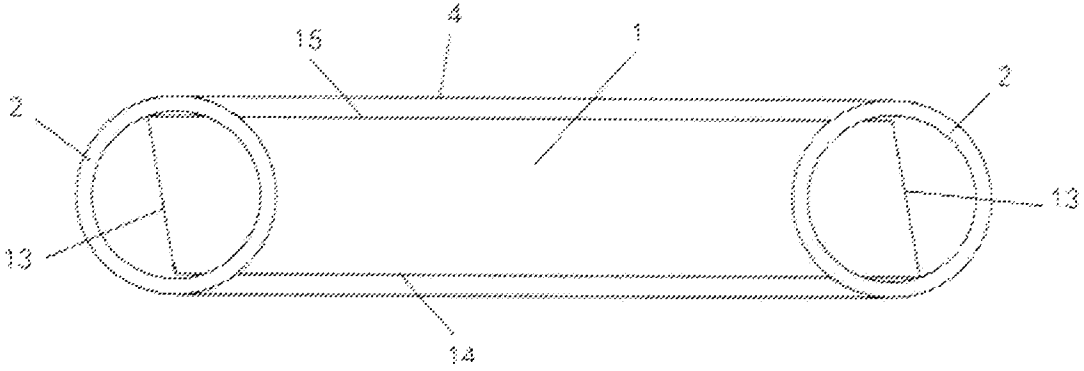
FIG. 22 is a top view of a bundled unfinned heat exchanger in an embodiment of the present invention.
Figure 23:
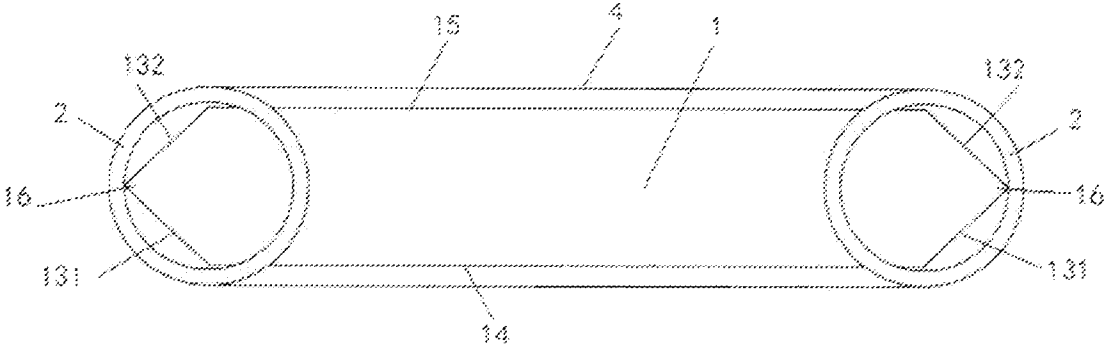
FIG. 23 is a top view of a bundled unfinned heat exchanger in an embodiment of the present invention.
Figure 25:
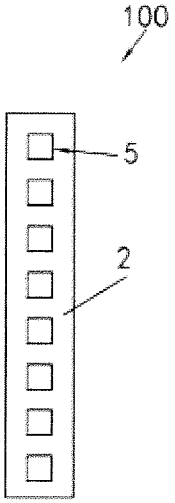
FIG. 25 is a side view of an unfinned heat exchanger in an embodiment of the present invention.
Figure 24:
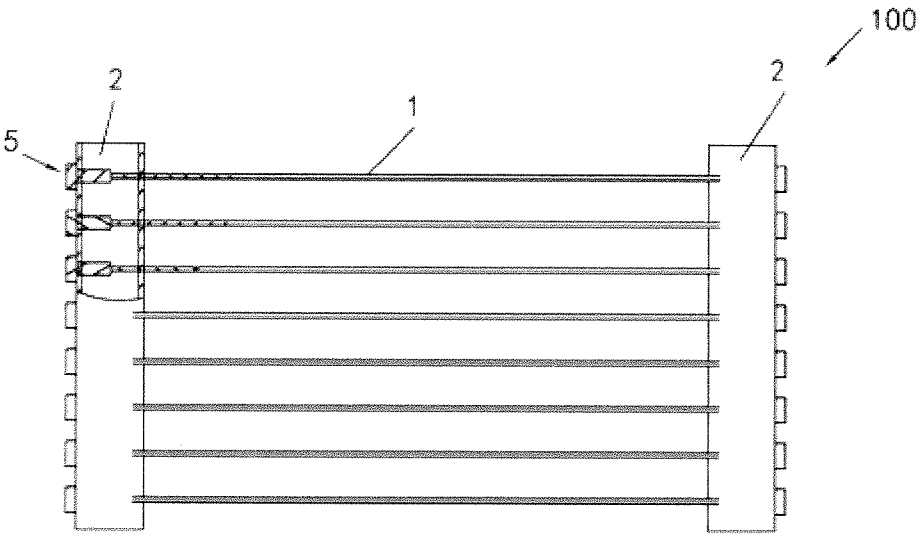
FIG. 24 is a front view of an unfinned heat exchanger in an embodiment of the present invention.
Figure 26:
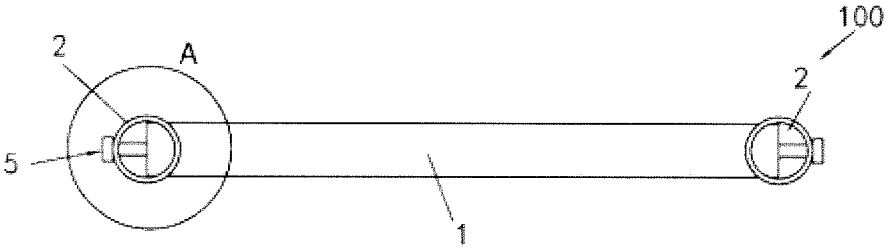
FIG. 26 is a top view of an unfinned heat exchanger in an embodiment of the present invention.
Figure 29:
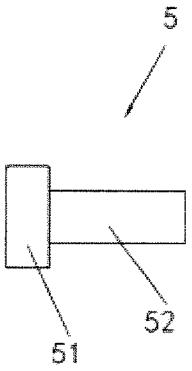
FIG. 29 is a front view of a supporting element of an unfinned heat exchanger in an embodiment of the present invention.
Figure 28:
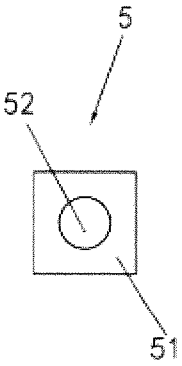
FIG. 28 is a side view of a supporting element of an unfinned heat exchanger in an embodiment of the present invention.
Figure 27:
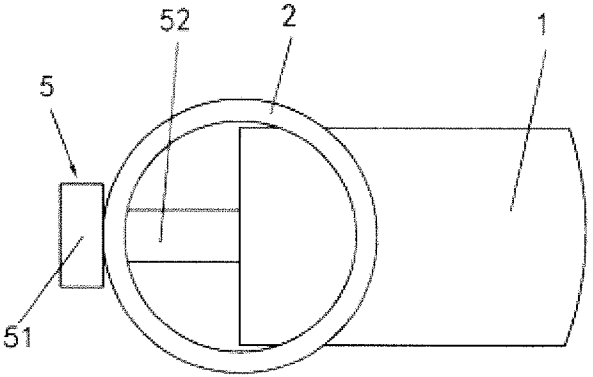
FIG. 27 is an enlarged partial view of part A (shown in FIG. 26) of an unfinned heat exchanger in an embodiment of the present invention.

See FIG. 22 and FIG. 23. In an embodiment of the present invention, the manifold 2 is bundled by use of a bundling strap 4 to bundle the assembled heat exchanger 100 together for welding.

See FIG. 22. In an embodiment of the present invention, two ends of said heat exchange tube 1 have endfaces 13 oblique to the longitudinal direction of the heat exchange tube 1. The oblique endfaces 13 of the two ends of said heat exchange tube 1 can be roughly parallel to each other. Thus, no scrap is produced when the heat exchange tube 1 is formed. The oblique endfaces of the two ends enable the ends to be inserted more deeply into the manifold 2 to support inner walls of the manifold 2, and in addition, the oblique endfaces also ensure that the flow resistance at the outlet of the heat exchange tube 1 will not increase when the ends are inserted more deeply into the manifold 2. The oblique endfaces 13 can be extended from a first edge 14 of the heat exchange tube 1 to a second edge 15 opposite to the first edge 14 in a widthwise direction of said heat exchange tube 1. For a traditional finned heat exchanger, heat exchange tube 1 is bundled by use of a bundling strap 4 in a direction parallel to the lengthwise direction of the manifolds to bundle the assembled heat exchanger 100 together for welding. In the embodiment of the present invention, the manifold 2 is bundled by use of a bundling strap 4 to bundle the assembled heat exchanger 100 together. Thus, a collapse caused by the pressure on the heat exchange tube 1 from bundling strap 4 because of no fin support between the heat exchange tubes 1 can be prevented when the traditional bundling method is used. Since the ends are supported on the inner walls of the manifold 2, it makes possible that the manifold 2 is bundled by use of the bundling strap 4 to bundle the assembled heat exchanger 100 together.

See FIG. 23. In the embodiment of the present invention, each of the two ends of said heat exchange tube 1 has a first endface portion 131 which is extended from a first edge 14 of the heat exchange tube 1 to a middle in a widthwise direction of said heat exchange tube 1 and is oblique to the longitudinal direction of the heat exchange tube 1, and a second endface portion 132 which is extended from a second edge 15 opposite to the first edge 14 in the widthwise direction of the heat exchange tube 1 to the middle in the widthwise direction of said heat exchange tube 1 and is oblique to the longitudinal direction of the heat exchange tube 1. A pointed portion 16 is formed between the first endface portion 131 and the second endface portion 132 and said pointed portion 16 contacts an inner wall of the manifolds. It should be pointed out that the term "middle" here is not limited to the center in the widthwise direction of the heat exchange tube 1 but refers to the middle part relative to the two ends of the heat exchange tube 1 in the widthwise direction. The oblique endfaces of the ends enable the ends to be inserted more deeply into the manifold 2 to support the inner wall of the manifold 2, and in addition, the oblique endfaces also ensure that the flow resistance at the outlet of the heat exchange tube 1 will not increase when the ends are inserted more deeply into the manifold 2. Since the ends are supported on the inner walls of the manifold 2, the manifold 2 can be bundled by use of a bundling strap 4 to bundle the assembled heat exchanger 100 together.

In some embodiments of the present invention, blocking structures contacting the outer walls of the manifolds 2, for example, bulges and shoulders formed when the ends of heat exchange tubes 1 are necked down, are provided on the heat exchange tubes 1.

See FIG. 24 to FIG. 29. In the embodiments of the present invention, the manifold 2 has an opening used to insert an end of the heat exchange tube 1 and a supporting element insertion mouth opposite to the opening, said heat exchanger 100 further comprises a supporting element 5, and said supporting element 5 is inserted from the supporting element mouth into the manifold 2 to abut the endface of the end of heat exchange tube 1 inserted from said opening. Said supporting element 5 can have the shape of a square-head bolt. Said supporting element 5 can have a rod portion 51 inserted into said insertion mouth and a head portion 52 connected to the rod portion 51 and located outside the manifolds 2, and said head portion 51 covers said insertion mouth. Said supporting element 5 abuts the endface of the end of the heat exchange tube 1 inserted into the manifold 2.

See FIG. 22 to FIG. 29. An end of said heat exchange tube 1 supports an inner wall of the manifold 2, an endface of said heat exchange tube 1 contacts an inner wall of the manifold 2, or an endface of said heat exchange tube 1 supports an inner wall of the manifold 2 through a supporting element 5 or the endface of said heat exchange tube 2 contacts the supporting element 5 connected to the manifold. The supporting element 5 can be welded (for example, spot welding) to the tube wall of the manifold 2 before the heat exchanger 100 is bundled, and then a bundling strap 4 can be used to bundle the manifold 2 to bundle the assembled heat exchanger 100 together for welding. Seal welding between the supporting element 5 and the tube wall of the manifold 2 can simultaneously be performed together with the welding of other components of the heat exchanger 100. Before the bundling of the heat exchanger, the supporting element 5 can also be in interference fit in a corresponding hole in the manifold 2 or mating threads are provided on the supporting element 5 and the corresponding hole in the manifold 2 to screw the supporting element into said hole. In some embodiments of the present invention, the endface of said heat exchange tube 2 contacts the supporting element 5 of the manifold connected thereto, and a strip-shaped element can be put on the head portion 52 of the supporting element 5 to prevent the supporting element 5 from falling off when the heat exchanger 100 is bundled. The bundled heat exchanger is put in a furnace for braze welding, and welding between the supporting element 5 and the tube wall of the manifold 2 can simultaneously be performed together with the welding of other components of the heat exchanger 100 to simplify the procedure.

See FIG. 30 to FIG. 33. In the embodiments of the present invention, at least one or all said heat exchange tubes 1 have a strip shape and are twisted into a spiral shape, and thus, turbulence is formed when air passes through the heat exchange tubes 1. Thus, the heat exchange performance is improved, and in addition, the bending strength of the heat exchange tubes 1 is also improved.

Figure 30:
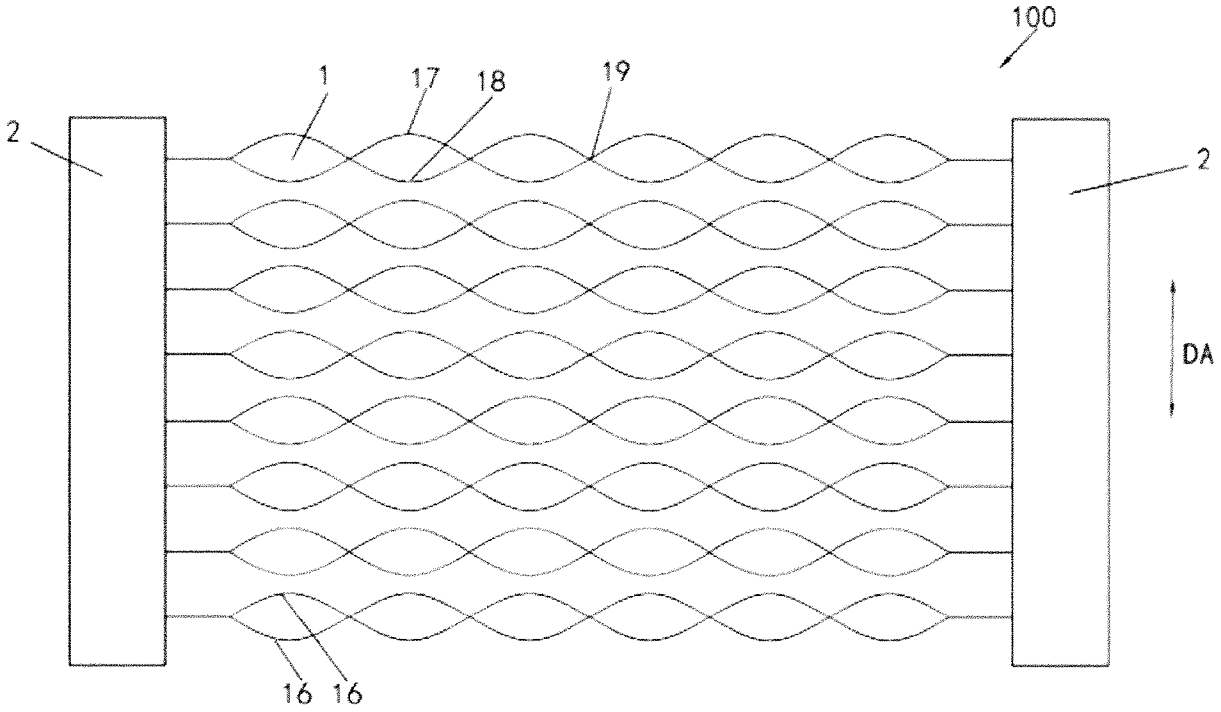
FIG. 30 is a front view of an unfinned heat exchanger in an embodiment of the present invention.
Figure 31:
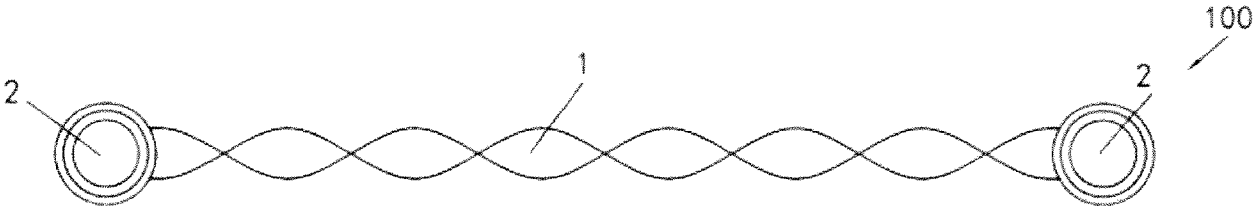
FIG. 31 is a top view of an unfinned heat exchanger in an embodiment of the present invention.
Figure 32:
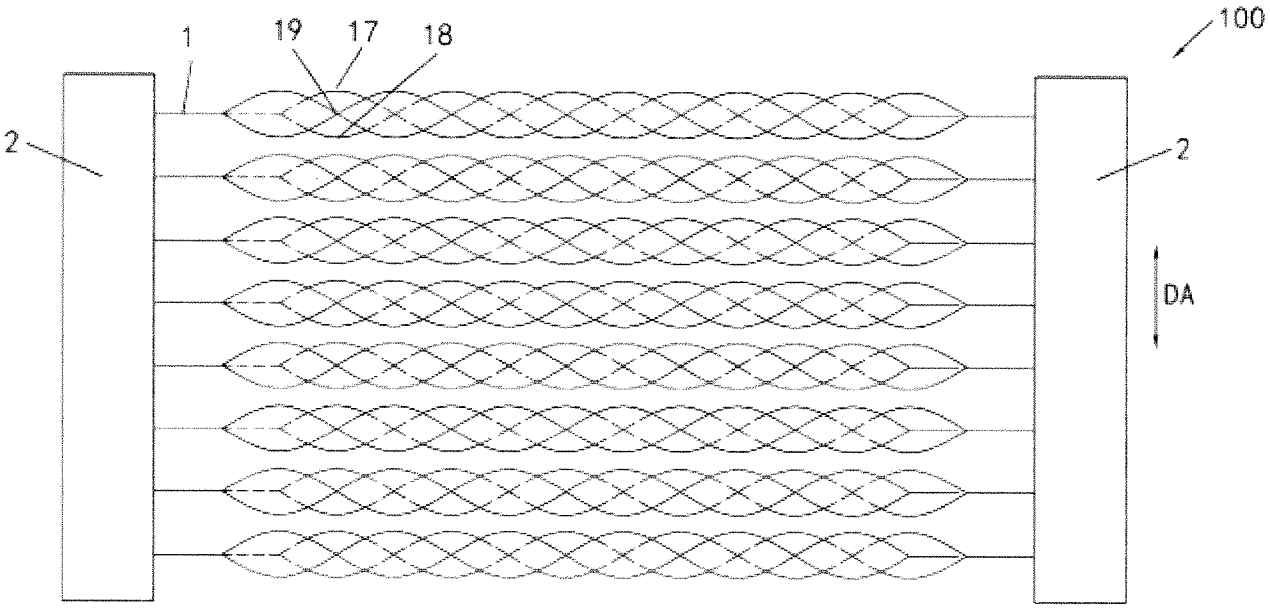
FIG. 32 is a front view of an unfinned heat exchanger in an embodiment of the present invention.
Figure 33:
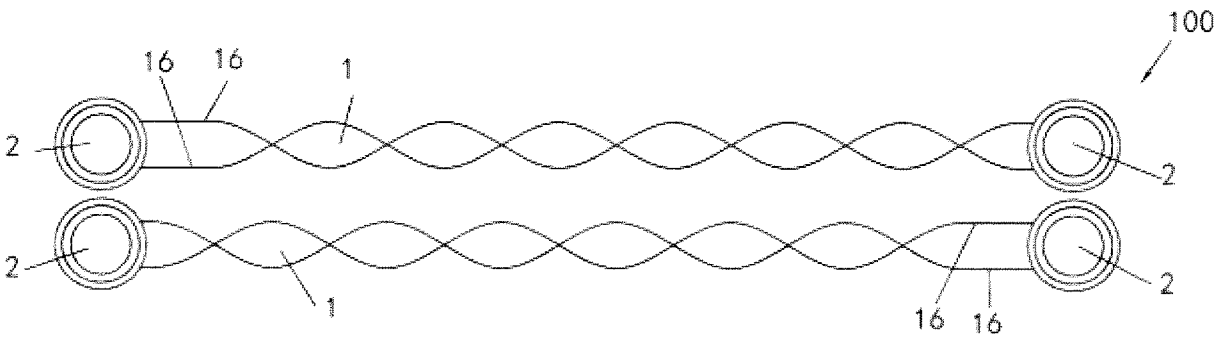
FIG. 33 is a top view of an unfinned heat exchanger in an embodiment of the present invention.

In the embodiments of the present invention, as shown in FIG. 30, FIG. 32 and FIG. 33, said heat exchange tubes 1 comprise a first row of heat exchange tubes 1 and a second row of heat exchange tubes 1, and each of said first row of heat exchange tubes 1 and second row of heat exchange tubes 1 has a strip shape and is twisted into a spiral shape. The two opposite edges 16 of each strip-shaped heat exchange tube 1 of said first row of heat exchange tubes 1 have a wave shape and have a first wave peak 17, a first wave trough 18 and a first intersection point 19 in a projection on a plane defined by the arrangement direction DA of the first row of heat exchange tube 1 and the longitudinal direction of the heat exchange tubes 1 of the first row of heat exchange tube 1. The two opposite edges 16 of each strip-shaped heat exchange tube 1 of said second row of heat exchange tube 1 have a wave shape and have a second wave peak 17, a second wave trough 18 and a second intersection point 19 in a projection on a plane defined by the arrangement direction DA of the second row of heat exchange tubes 1 and the longitudinal direction of heat exchange tubes 1 of the second row of heat exchange tube 1, and said first wave peak 17 and first wave trough 18 and said second wave peak 17 and second wave trough 18 are staggered in the longitudinal direction of the heat exchange tubes 1 of the first row of heat exchange tubes 1 or second row of heat exchange tubes 1. As shown in FIG. 32, for example, said first wave peak 17 and first wave trough 18 are roughly located in the same position as the second intersection point 19 in the longitudinal direction of the heat exchange tubes 1 of the first row of heat exchange tube 1 or second row of heat exchange tube 1, or said second wave peak 17 and second wave trough 18 are roughly located in the same position as the first intersection point 19 in the longitudinal direction of the heat exchange tubes 1 of the first row of heat exchange tube 1 or second row of heat exchange tube 1. The first row of heat exchange tubes 1 and the second row of heat exchange tubes 1 can have the same spiral shape, and thus air is forced to flow in the lateral direction between the two rows of heat exchange tubes to more effectively utilize the heat exchange surface.

In the embodiments of the present invention, as shown in FIG. 34 to FIG. 37, said heat exchange tubes 1 have a strip shape, and said heat exchange tubes 1 have a wave shape in the projection on the plane defined by the arrangement direction DA of heat exchange tubes 1 and the longitudinal direction of heat exchange tubes 1. Thus, turbulence is formed when air passes through the heat exchange tubes 1. Thus, the heat exchange performance is improved, the bending strength of the heat exchange tubes 1 is also improved, and the heat exchange area is increased.

In the embodiments of the present invention, as shown in FIG. 34 to FIG. 37, said heat exchange tubes 1 have a strip shape, and in the projection on a plane defined by the arrangement direction DA of heat exchange tubes 1 and the longitudinal direction of heat exchange tubes 1, said heat exchange tubes 1 have a wave shape and have a wave peak 17 and a wave trough 18, and the wave trough 18 of one heat exchange tube 1 and the wave peak 17 of another lower and adjacent heat exchange tube 1 are roughly located in the same position in the longitudinal direction of heat exchange tubes 1 and can contact each other (for example, they are welded together), or are staggered a preset distance in the longitudinal direction of the heat exchange tubes 1.

Figure 34:
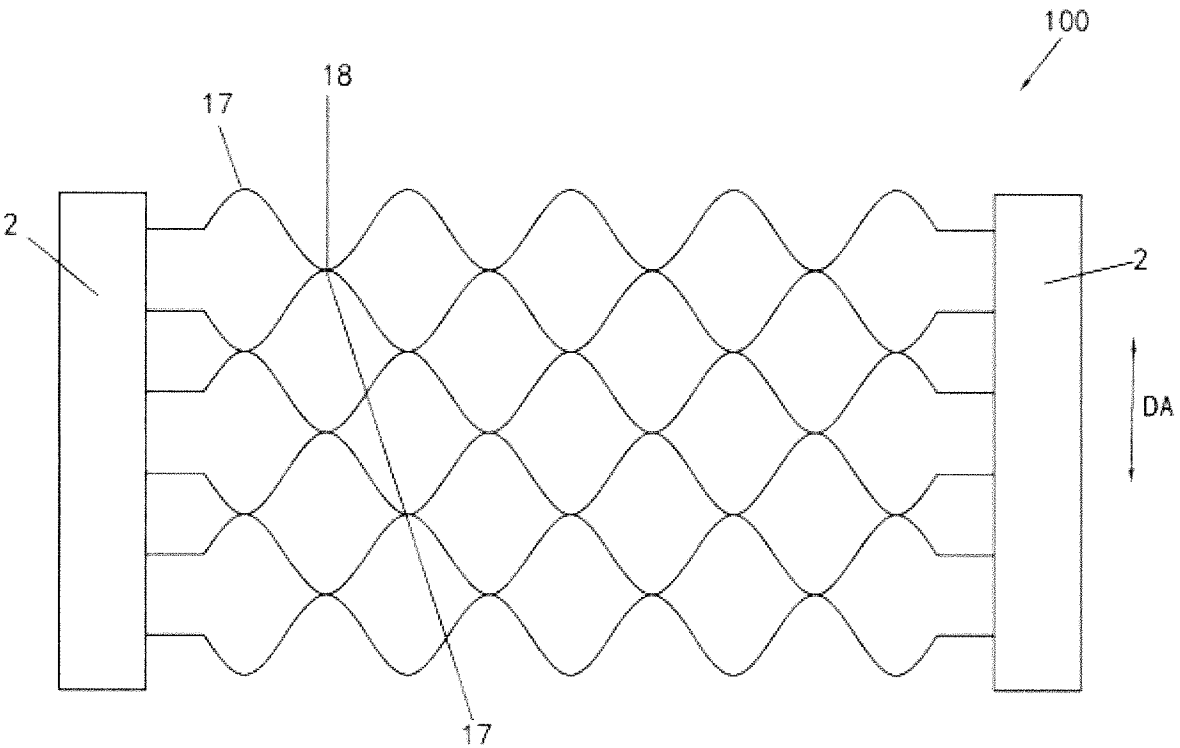
FIG. 34 is a front view of an unfinned heat exchanger in an embodiment of the present invention.
Figure 35:
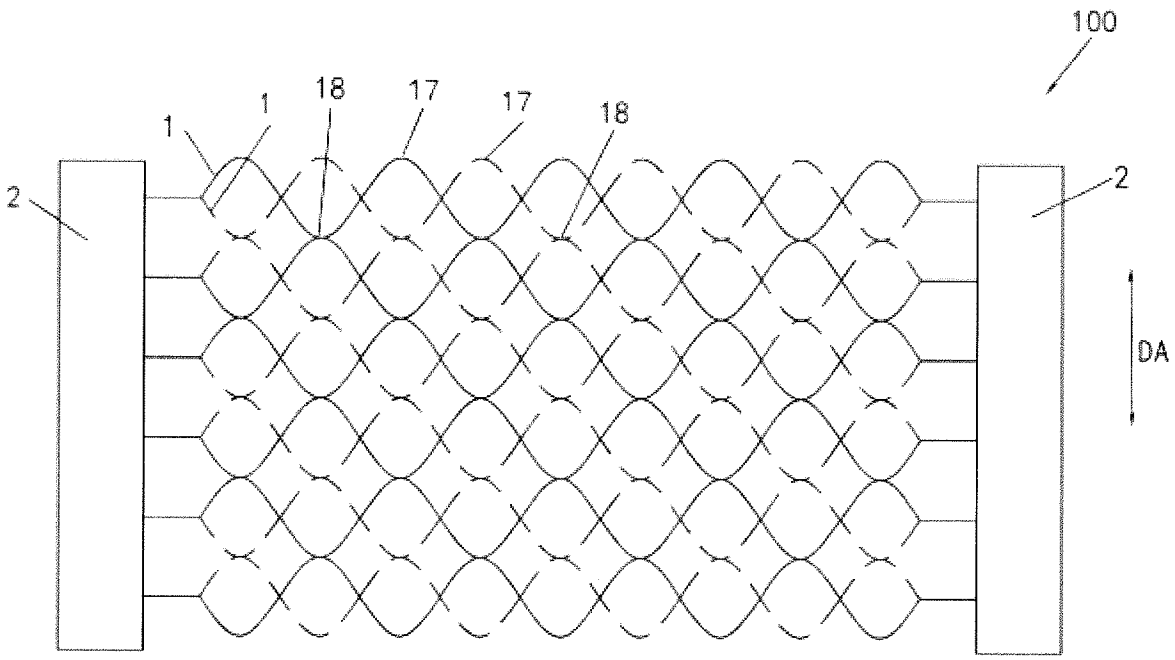
FIG. 35 is a front view of an unfinned heat exchanger in an embodiment of the present invention.
Figure 37:
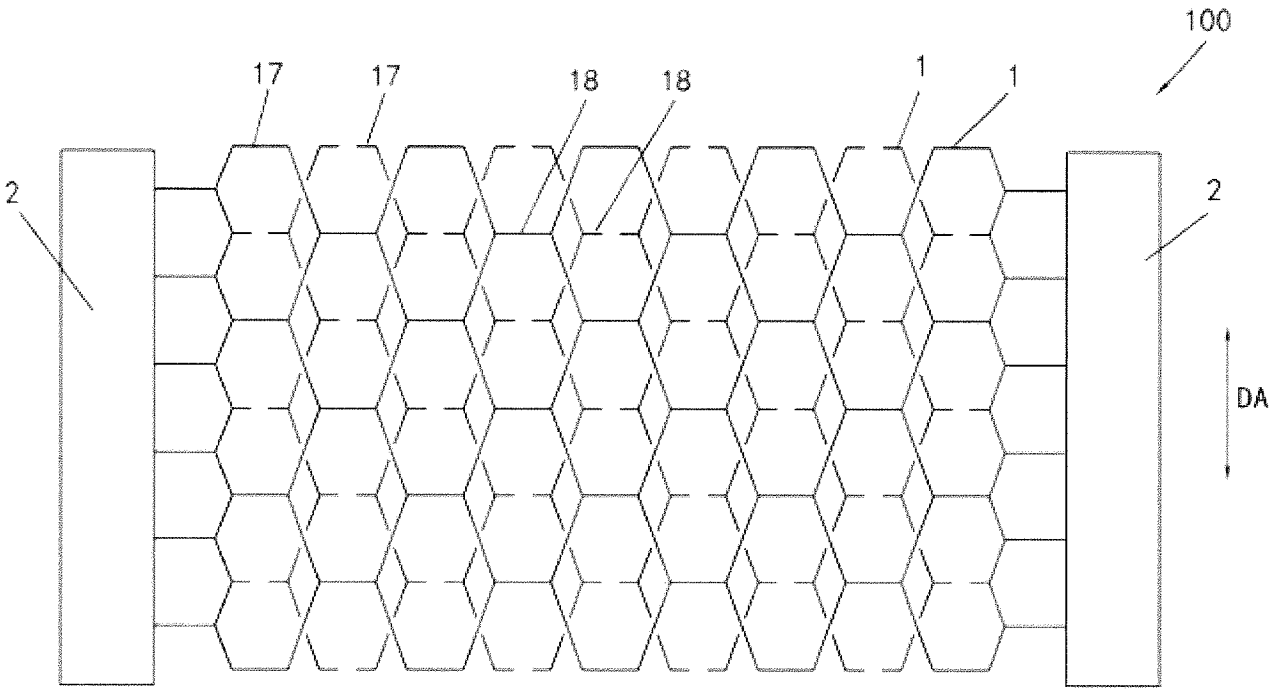
FIG. 37 is a front view of an unfinned heat exchanger in an embodiment of the present invention.

In the embodiments of the present invention, as shown in FIG. 34, FIG. 35 and FIG. 37, said heat exchange tubes 1 comprise a first row of heat exchange tubes 1 and a second row of heat exchange tubes 1, and each of said first row of heat exchange tubes 1 and second row of heat exchange tubes 1 has a strip shape. Each of said first row of heat exchange tubes 1 has a wave shape and has a wave peak 17 and a wave trough 18, in a projection on a plane defined by the arrangement direction DA of the first row of heat exchange tubes 1 and the longitudinal direction of the heat exchange tubes 1 of the first row of heat exchange tubes 1, and the wave trough 18 of one heat exchange tube 1 of said first row of heat exchange tubes 1 and the wave peak 17 of another lower and adjacent heat exchange tube 1 of said first row of heat exchange tubes 1 are roughly located in the same position in the longitudinal direction of the heat exchange tubes 1 of said first row of heat exchange tubes 1 and can contact each other (for example, they are welded together). Each of said second row of heat exchange tubes 1 has a strip shape and has a wave peak 17 and a wave trough 18, in a projection on a plane defined by the arrangement direction DA of the second row of heat exchange tubes 1 and the longitudinal direction of the heat exchange tubes 1 of the second row of heat exchange tubes 1, and the wave trough 18 of one heat exchange tube 1 of said second row of heat exchange tubes 1 and the wave peak 17 of another lower and adjacent heat exchange tube 1 of said second row of heat exchange tubes 1 are roughly located in the same position in the longitudinal direction of the heat exchange tubes 1 of said second row of heat exchange tubes 1 and can contact each other (for example, they are welded together). The wave peak 17 or wave trough 18 of one identically-positioned heat exchange tube 1 of said first row of heat exchange tubes 1 is staggered from the wave peak 17 or wave trough 18 of one identically-positioned heat exchange tube 1 of said second row of heat exchange tubes 1 in the same position of said one identically-positioned heat exchange tube, in the longitudinal direction of the heat exchange tubes 1 of said first row of heat exchange tubes 1 or second row of heat exchange tubes 1 and in the arrangement direction DA of the first row of heat exchange tubes 1 or the second row of heat exchange tubes 1. For example, the wave peak 17 or wave trough 18 of one identically-positioned heat exchange tube 1 of said first row of heat exchange tubes 1 and the wave trough 18 or wave peak 17 of one identically-positioned heat exchange tube 1 of said second row of heat exchange tubes 1 in the same position of said one identically-positioned heat exchange tube 1 are roughly located in the same position in the longitudinal direction of the heat exchange tubes 1 of the first row of heat exchange tubes 1 or second row of heat exchange tubes 1 and in the arrangement direction DA of the first row of heat exchange tubes 1 or the second row of heat exchange tubes 1. Thus, the flow of air is disturbed to produce turbulence to improve the heat exchange performance.

In the embodiments of the present invention, as shown in FIG. 30, FIG. 32 and FIG. 33, said heat exchange tubes 1 comprise a first row of heat exchange tubes 1 and a second row of heat exchange tubes 1, at least one heat exchange tube of said first row of heat exchange tubes 1 has a strip shape and is twisted into a spiral shape, and at least one heat exchange tube of the second row of heat exchange tubes 1 has a strip shape and is twisted into a spiral shape. The two opposite edges 16 of the strip-shaped heat exchange tubes 1 of said first row of heat exchange tubes 1 have a wave shape and have a first wave peak 17, a first wave trough 18 and a first intersection point 19, in the projection on the plane defined by the arrangement direction DA of the first row of heat exchange tubes 1 and the longitudinal direction of the heat exchange tubes 1 of the first row of heat exchange tubes 1. The two opposite edges 16 of the strip-shaped heat exchange tubes 1 of said second row of heat exchange tubes 1 have a wave shape and have a second wave peak 17, a second wave trough 18 and a second intersection point 19, in the projection on the plane defined by the arrangement direction DA of the second row of heat exchange tubes 1 and the longitudinal direction of heat exchange tubes 1 of the second row of heat exchange tubes 1, and said first wave peak 17 and first wave trough 18 are staggered from said second wave peak 17 and second wave trough 18 in the longitudinal direction of the heat exchange tubes 1 of the first row of heat exchange tubes 1 or second row of heat exchange tubes 1. As shown in FIG. 32, for example, said first wave peak 17, first wave trough 18 and second intersection point 19 are roughly located in the same position in the longitudinal direction of the heat exchange tubes 1 of the first row of heat exchange tubes 1 or second row of heat exchange tubes 1, or said second wave peak 17, second wave trough 18 and first intersection point 19 are roughly located in the same position in the longitudinal direction of the heat exchange tubes 1 of the first row of heat exchange tubes 1 or second row of heat exchange tubes 1. At least one heat exchange tube of the first row of heat exchange tubes 1 and at least one heat exchange tube of the second row of heat exchange tubes 1 can have the same spiral shape, and thus air is forced to flow in the lateral direction between the two rows of heat exchange tubes 1 to more effectively utilize the heat exchange surface.

In the embodiments of the present invention, as shown in FIG. 34 to FIG. 37, at least one of said heat exchange tubes 1 has a strip shape and has a wave shape in the projection on the plane defined by the arrangement direction DA of heat exchange tubes 1 and the longitudinal direction of heat exchange tubes 1. Thus, turbulence is formed when air passes through the heat exchange tubes 1. Thus, the heat exchange performance is improved, the bending strength of the heat exchange tubes 1 is also improved, and the heat exchange area is increased.

In the embodiments of the present invention, as shown in FIG. 34 to FIG. 37, at least two adjacent heat exchange tubes of said heat exchange tubes 1 have a strip shape, said at least two heat exchange tubes have a wave shape and have a wave peak 17 and a wave trough 18 in the projection on the plane defined by the arrangement direction DA of heat exchange tubes 1 and the longitudinal direction of heat exchange tubes 1, and the wave trough 18 of one heat exchange tube 1 of said at least two heat exchange tubes and the wave peak 17 of the other lower and adjacent heat exchange tube 1 are roughly located in the same position and can contact each other (for example, they are welded together), or are staggered a preset distance in the longitudinal direction of the heat exchange tubes 1.

In the embodiments of the present invention, as shown in FIG. 34, FIG. 35 and FIG. 37, said heat exchange tubes 1 comprise a first row of heat exchange tubes 1 and a second row of heat exchange tubes 1, at least two adjacent heat exchange tubes 1 of said first row of heat exchange tubes 1 have a strip shape, and at least two adjacent heat exchange tubes 1 of the second row of heat exchange tubes 1 have a strip shape, said at least two heat exchange tubes of said first row of heat exchange tubes 1 have a wave shape and have a wave peak 17 and a wave trough 18 in a projection on a plane defined by the arrangement direction DA of the first row of heat exchange tubes 1 and the longitudinal direction of the heat exchange tubes 1 of the first row of heat exchange tubes 1, and the wave trough 18 of one heat exchange tube 1 of said at least two heat exchange tubes of said first row of heat exchange tubes 1 and the wave peak 17 of the other lower and adjacent heat exchange tube 1 of said first row of heat exchange tubes 1 are roughly located in the same position in the longitudinal direction of heat exchange tubes 1 of said first row of heat exchange tubes 1 and can contact each other (for example, they are welded together); said at least two heat exchange tubes in said second row of heat exchange tubes 1 have a wave shape and have a wave peak 17 and a wave trough 18 in a projection on a plane defined by the arrangement direction DA of the second row of heat exchange tubes 1 and the longitudinal direction of the heat exchange tubes 1 of the second row of heat exchange tubes 1, and the wave trough 18 of one heat exchange tube 1 of said at least two heat exchange tubes of said second row of heat exchange tubes 1 and the wave peak 17 of the other lower and adjacent heat exchange tube 1 of said at least two heat exchange tubes of said second row of heat exchange tubes 1 are roughly located in the same position in the longitudinal direction of the heat exchange tubes 1 of the second row of heat exchange tubes 1 and can contact each other (for example, they are welded together); the wave peak 17 or wave trough 18 of one identically-positioned heat exchange tube 1 of said at least two heat exchange tubes of said first row of heat exchange tubes is staggered from the wave peak 17 or wave trough 18 of one identically-positioned heat exchange tube 1 of said at least two heat exchange tubes of said second row of heat exchange tubes 1 in the same position of said one identically-positioned heat exchange tube, in the longitudinal direction of the heat exchange tubes 1 of the first row of heat exchange tubes 1 or second row of heat exchange tubes 1 and in the arrangement direction DA of the first row of heat exchange tubes 1 or second row of heat exchange tubes 1. For example, the wave peak 17 or wave trough 18 of one identically-positioned heat exchange tube 1 of said at least two heat exchange tubes of said first row of heat exchange tubes 1 and the wave trough 18 or wave peak 17 of one identically-positioned heat exchange tube 1 of said at least two heat exchange tubes of said second row of heat exchange tubes 1 in the same position of said one identically-positioned heat exchange tube 1 are roughly located in the same position in the longitudinal direction of the heat exchange tubes 1 of the first row of heat exchange tubes 1 or second row of heat exchange tubes 1 and in the arrangement direction DA of the first row of heat exchange tubes 1 or the second row of heat exchange tubes 1. Thus, the flow of air is disturbed to produce turbulence to improve the heat exchange performance.

Figure 36:
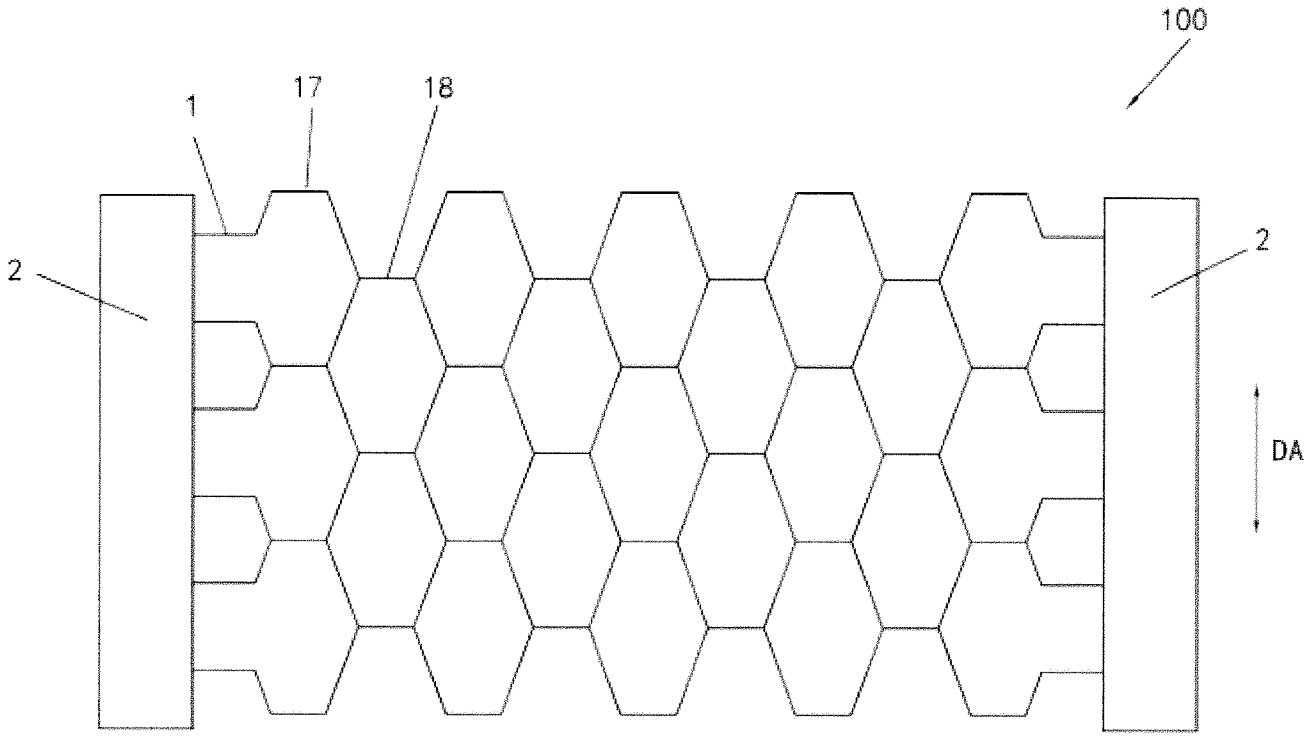
FIG. 36 is a front view of an unfinned heat exchanger in an embodiment of the present invention.

Said wave shape can be a sinusoidal wave shape or a trapezoidal wave shape, or a rectangular wave shape, etc. For example, the first row of heat exchange tubes 1 and the second row of heat exchange tubes 1 can have the same wave shape. As shown in FIG. 36, the heat exchange tubes 1 can form a cellular structure. The following describes the manufacturing method of the unfinned heat exchanger in the embodiments of the present invention by reference to FIG. 22 and FIG. 23.

See FIG. 22 and FIG. 23. A manufacturing method of an unfinned heat exchanger in an embodiment of the present invention comprises: providing a heat exchange tube and a manifold, the manifold having an opening used to insert an end of the heat exchange tube, inserting the end of the heat exchange tube into the opening in the manifold, bundling the heat exchanger by use of a long and thin strapping piece, with a part of the strapping piece wound on a part of the outer circumference of the manifold, and braze welding the heat exchanger in a heating furnace.

See FIG. 22 and FIG. 23. The strapping piece 4 is extended roughly in a plane forming a preset angle with an axial direction of the manifold. Said preset angle is roughly 90 degrees.

See FIG. 22 to FIG. 29. An end of said heat exchange tube 15 supports an inner wall of the manifolds 2, an endface of said heat exchange tube 15 contacts an inner wall of the manifold 2, or the endface of said heat exchange tube 15 supports the inner wall of the manifold 2 through a supporting element 5 or the endface of said heat exchange tube 2 contacts the supporting element 5 connected to the manifold 2.

The heat exchanger in the embodiments of the present invention can reduce the accumulation of dirt on the heat exchanger.

Although the above-mentioned embodiments are described, some characteristics in the above-mentioned embodiments can be combined to form new embodiments.

What is claimed is:

1. An unfinned heat exchanger, comprising:

a heat exchange tube which comprises a body, a fluid passage formed in said body, and a manifold connected to said heat exchange tube, wherein said heat exchange tube comprises a first row of heat exchange tube and a second row of heat exchange tube, at least one heat exchange tube of said first row of heat exchange tube has a strip shape and is twisted into a spiral shape, at least one heat exchange tube of said second row of heat exchange tube has a strip shape and is twisted into a spiral shape, two opposite edges of the strip-shaped heat exchange tube of said first row of heat exchange tube have a wave shape and have a first wave peak, a first wave trough and a first intersection point in a projection on a plane defined by an arrangement direction of the first row of heat exchange tube and a longitudinal direction of the heat exchange tube of the first row of heat exchange tube, two opposite edges of the strip-shaped heat exchange tube of said second row of heat exchange tube have a wave shape and have a second wave peak, a second wave trough and a second intersection point in a projection on a plane defined by an arrangement direction of the second row of heat exchange tube and a longitudinal direction of the heat exchange tube of the second row of heat exchange tube, and said first wave peak and first wave trough are staggered from said second wave peak and second wave trough in a longitudinal direction of the heat exchange tube of the first row of heat exchange tube or second row of heat exchange tube.

2. The unfinned heat exchanger as claimed in claim 1, wherein the body of said heat exchange tube has at least two straight-line body portions, when viewed from its cross-section.

3. The unfinned heat exchanger as claimed in claim 1, wherein the body of said heat exchange tube comprises three straight-line body portions, when viewed from its cross-section, wherein the first body portion of the three straight-line body portions is extended in a first direction, the second body portion of the three straight-line body portions is extended from an end of the first body portion in a second direction oblique to the first direction, and the third body portion of the three straight-line body portions is extended from an end of the second body portion, away from the first body portion, in a third direction roughly parallel to the first direction.

4. The unfinned heat exchanger as claimed in claim 1, wherein the body of said heat exchange tube comprises four straight-line body portions, when viewed from its cross-section, and the body of said heat exchange tube is in the shape of an inverted W.

5. The unfinned heat exchanger as claimed in claim 1, wherein said heat exchange tube further comprises at least one bulge formed on a surface of said body.

6. The unfinned heat exchanger as claimed in claim 5, wherein said bulge is continuously extended in a longitudinal direction of said heat exchange tube.

7. The unfinned heat exchanger as claimed in claim 1, wherein said heat exchange tube comprises a first row of heat exchange tube and a second row of heat exchange tube, and the first row of heat exchange tube and the second row of heat exchange tube are mutually staggered in an arrangement direction of the heat exchange tubes.

8. The unfinned heat exchanger as claimed in claim 1, wherein said manifold comprises a first manifold and a second manifold respectively connected to the first row of heat exchange tube and the second row of heat exchange tube, and a position of an opening used to insert an end of the first row of heat exchange tube in the first manifold and a position of an opening used to insert an end of the second row of heat exchange tube in the second manifold are mutually staggered in an arrangement direction of the first row of heat exchange tube or the second row of heat exchange tube.

9. The unfinned heat exchanger as claimed in claim 8, wherein an endface of the first manifold and an endface of the second manifold, which are on a same side in said arrangement direction, are roughly aligned in said arrangement direction, or an endface of the first manifold and an endface of the second manifold, which are on the same side in said arrangement direction, are spaced at a preset distance in said arrangement direction.

10. The unfinned heat exchanger as claimed in claim 8, wherein the first manifold is a first pair of manifolds and the second manifold is a second pair of manifolds.

11. The unfinned heat exchanger as claimed in claim 8, wherein the first manifold and the second manifold are connected to a first end and a second end of the heat exchange tube, respectively, said heat exchange tube is bent in its middle to form a first row of heat exchange tube and a second row of heat exchange tube, and the first manifold and the second manifold are located on a same side of the heat exchanger.

12. The unfinned heat exchanger as claimed in claim 1, wherein at least one of said heat exchange tube has a strip shape and is twisted into a spiral shape.

13. The unfinned heat exchanger as claimed in claim 1, wherein said first wave peak and first wave trough are roughly located in a same position as the second intersection point in the longitudinal direction of the heat exchange tube of the first row of heat exchange tube or second row of heat exchange tube or said second wave peak and second wave trough are roughly located in a same position as the first intersection point in the longitudinal direction of the heat exchange tube of the first row of heat exchange tube or second row of heat exchange tube.

14. The unfinned heat exchanger as claimed in claim 1, wherein at least one of said heat exchange tube has a strip shape and has a wave shape in a projection on a plane defined by an arrangement direction of the heat exchange tube and a longitudinal direction of the heat exchange tube.

15. The unfinned heat exchanger as claimed in claim 1, wherein at least two adjacent heat exchange tubes of said heat exchange tube have a strip shape, said at least two heat exchange tubes of said heat exchange tube have a wave shape and have a wave peak and a wave trough in a projection on a plane defined by an arrangement direction of the heat exchange tube and a longitudinal direction of the heat exchange tube, and the wave trough of one heat exchange tube of said at least two heat exchange tubes and the wave peak of the other lower and adjacent heat exchange tube are roughly located in a same position, or are staggered a preset distance in the longitudinal direction of the heat exchange tube.

16. The unfinned heat exchanger as claimed in claim 1, wherein said heat exchange tube comprises a first row of heat exchange tube and a second row of heat exchange tube, at least two adjacent heat exchange tubes of said first row of heat exchange tube have a strip shape, at least two adjacent heat exchange tubes of the second row of heat exchange tube have a strip shape, said at least two heat exchange tubes of said first row of heat exchange tube have a wave shape and have a wave peak and a wave trough in a projection on a plane defined by an arrangement direction of the first row of heat exchange tube and a longitudinal direction of the heat exchange tube of the first row of heat exchange tube, and the wave trough of one heat exchange tube of said at least two heat exchange tubes of said first row of heat exchange tube and the wave peak of the other lower and adjacent heat exchange tube of said at least two heat exchange tubes of said first row of heat exchange tube are roughly located in a same position in a longitudinal direction of the heat exchange tube of the first row of heat exchange tube; said at least two heat exchange tubes in said second row of heat exchange tube have a wave shape and have a wave peak and a wave trough in a projection on a plane defined by an arrangement direction of the second row of heat exchange tube and a longitudinal direction of the heat exchange tube of the second row of heat exchange tube, and the wave trough of one heat exchange tube of said at least two heat exchange tubes of said second row of heat exchange tube and the wave peak of the other lower and adjacent heat exchange tube of said at least two heat exchange tubes of said second row of heat exchange tube are roughly located in a same position in the longitudinal direction of the heat exchange tube of the second row of heat exchange tube; a wave peak or a wave trough of one identically-positioned heat exchange tube of said at least two heat exchange tubes of said first row of heat exchange tube is staggered from a wave peak or a wave trough of one identically-positioned heat exchange tube of said at least two heat exchange tubes of said second row of heat exchange tube in the same position of said one identically-positioned heat exchange tube in a longitudinal direction of the heat exchange tube of the first row of heat exchange tube or second row of heat exchange tube and in an arrangement direction of the first row of heat exchange tube or second row of heat exchange tube.

17. The unfinned heat exchanger as claimed in claim 16, wherein the wave peak or the wave trough of one identically-positioned heat exchange tube of said at least two heat exchange tubes of said first row of heat exchange tube is located roughly in a same position as the wave trough or the wave peak of one identically-positioned heat exchange tube of said at least two heat exchange tubes of said second row of heat exchange tube in the same position of said one identically-positioned heat exchange tube in a longitudinal direction of the heat exchange tube of the first row of heat exchange tube or second row of heat exchange tube and in an arrangement direction of the first row of heat exchange tube or second row of heat exchange tube.

* * * * *